US006164113A

United States Patent [19]

Parker

[11] Patent Number: 6,164,113

[45] Date of Patent: Dec. 26, 2000

[54] VARIABLE-SPEED PIPE BENDING

[75] Inventor: Billy J. Parker, Holdenville, Okla.

[73] Assignee: CRC-Evans Pipeline International, Inc., Houston, Tex.

[21] Appl. No.: 09/524,875

[22] Filed: Mar. 14, 2000

[51] Int. Cl.[7] ..... B21D 9/05

[52] U.S. Cl. ..... 72/307; 72/308; 72/369; 72/388; 72/466

[58] Field of Search ..... 72/307, 308, 380, 72/381, 386, 387, 388, 391.1

[56] References Cited

U.S. PATENT DOCUMENTS

| | | | |
|---|---|---|---|
| 3,335,588 | 8/1967 | Cummings | 72/388 |
| 3,834,210 | 9/1974 | Clavin et al. | 72/308 |
| 3,851,519 | 12/1974 | Clavin et al. | 72/466 |
| 4,313,330 | 2/1982 | Cummings | 72/388 |
| 4,446,713 | 5/1984 | Wheeler et al. | 72/308 |
| 5,092,150 | 3/1992 | Cunningham | 72/369 |

OTHER PUBLICATIONS

*Industrial Fluid Power*, Charles S. Hedges, Womack Educational Publications, 1994, pp 124–127.

*Primary Examiner*—David Jones
*Attorney, Agent, or Firm*—Sidley & Austin

[57] ABSTRACT

A pipe bending apparatus is disclosed for bending pipe sections, particularly pipe sections of the type used in pipelines. The apparatus allows rapid clamping of the pipe section at reduced pressure via hydraulic fluid regeneration, while providing full hydraulic force for pipe section bending.

5 Claims, 7 Drawing Sheets

VARIABLE-SPEED PIPE BENDING

BACKGROUND OF THE INVENTION

Pipelines are utilized throughout the world for the long-distance transportation of oil, gas, industrial chemicals and other such fluids. A pipeline is typically constructed from large steel pipe sections (40–80 feet in length and 20–48 inches in diameter) which are welded together along the pipeline route and then buried underground. However, while the pipe sections delivered to the pipeline construction site are typically straight, pipeline routes rarely follow a straight line. Rather, most pipeline routes include numerous horizontal and/or vertical curves provided to follow the contours of the earth, to detour around obstacles, or because of land ownership considerations. Efficiently bending the massive sections of pipe to allow the pipeline to follow the preselected route remains a major challenge to the pipeline construction industry.

Portable pipe bending machines have been developed which permit the bending of massive pipe sections to the desired degree of curvature at the site of installation. Because of the size of the pipes being bent, the pipe bending equipment is generally massive in nature and operated hydraulically. Examples of such hydraulically-operated pipe bending machines are disclosed in U.S. Pat. No. 5,092,150 to Cunningham, U.S. Pat. No. 3,834,210 to Clavin, et al., and U.S. Pat. No. 3,851,519 to Clavin, et al., the disclosures of which are incorporated herein by reference. The pipe section is typically inserted into the bending machine to the location desired for the bend and then clamped into place. Next, the bending force is applied to bend the pipe. Finally, the machine releases the pipe for repositioning. In many cases, the degree of curvature needed for a particular pipe section exceeds the amount which can be formed by a single bend without damaging the pipe. In such cases, a succession of laterally spaced-apart bends will be made on a single pipe section to obtain the desired curvature.

The operation of hydraulic pipe bending machines may be controlled manually by a human operator or it may be controlled by a microprocessor or other form of automatic controller. Regardless of the form of control, however, hydraulically powered mechanisms are generally used for moving the pipe section into the bending position, for clamping it in place, for applying the bending force, and then for releasing the section in preparation for the next successive bending operation. It will be readily apparent that the time required for these hydraulic mechanisms to move through their operational ranges defines the lower limit on the time necessary to perform a single bend. Increasing the operating speed of the hydraulic apparatus will thus allow a reduction in the time required for bending, thus increasing the efficiency of the bending machine.

Increasing the speed of a hydraulic cylinder is usually achieved by increasing the fluid flow rate to the cylinder or by reducing the area of the cylinder. However, increasing the flow rate generally requires increasing the size of the hydraulic pump power source. Decreasing the cylinder area requires higher fluid pressure to maintain the same output force, and achieving this higher pressure also requires increasing the size of the hydraulic pump power source. A more powerful hydraulic power source raises the initial cost of the bending machine as well as its hourly operating cost due to increased fuel usage.

It can be seen from the foregoing that a need exists for a pipe bending machine which operates faster than a conventional machine having a comparably sized power source and maximum bending force. A further need exists for equipment that is easily retrofit to existing pipe bending machines to increase their operating speed without reducing their maximum bending force. Another need exists for a method of bending a pipe which provides increased bending speed without requiring additional hydraulic power or reducing the maximum bending force.

SUMMARY OF THE INVENTION

The present invention is for an apparatus and a method for bending pipes of large diameter. The apparatus includes two major portions, a bending mechanism and a hydraulic system to power the bending mechanism. The bending mechanism includes three components: a bending die, a stiffback, and at least one outboard bending cylinder. The bending die is rigidly attached to a frame of the apparatus, while the stiffback is flexibly attached to the frame and moves via operation of the bending cylinder. Operation of the bending cylinder moves the stiffback toward the bending die to clamp or bend the pipe.

The hydraulic fluid supply system includes two components: a hydraulic pump and at least one pressure-sensitive regenerative valve assembly. When the pressurized hydraulic fluid being supplied from the hydraulic pump to a blind end of the bending cylinder is less than a predetermined pressure, the hydraulic fluid exits a rod end of the bending cylinder and is routed into the blind end of the bending cylinder. This regenerative flows allows for rapid action, albeit at reduced force, of the stiffback for clamping the pipe. When the supplied hydraulic fluid has pressure greater than the predetermined pressure, the hydraulic fluid is routed back to the hydraulic pump. This conventional hydraulic fluid flow allows for the application of full force by the stiffback for bending of the pipe.

BRIEF DESCRIPTION OF THE DRAWINGS

Further features and advantages will become more apparent from the following and more particular description of the invention, as illustrated in the accompanying drawings, in which like referenced characters generally refer to the same parts throughout the views, and in which.

DETAILED DESCRIPTION

Figure 1:
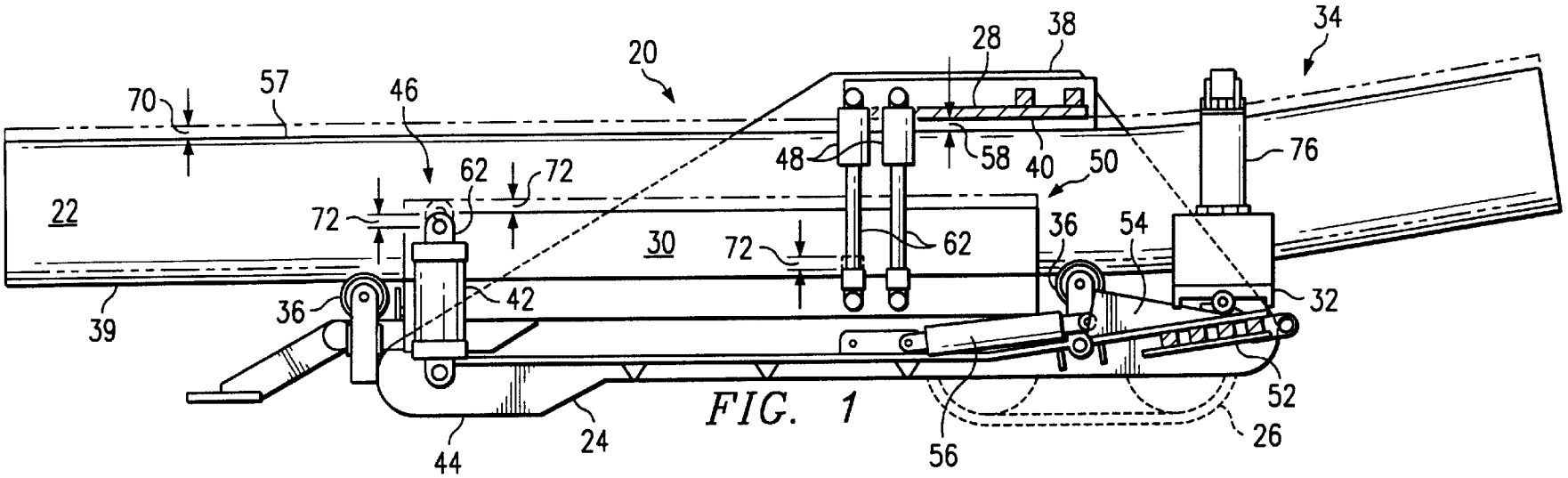
FIG. 1 is a side view of a pipe bending apparatus according to a preferred embodiment of the current invention with a pipe section loaded therein in the starting position for a bend.
Figure 2:
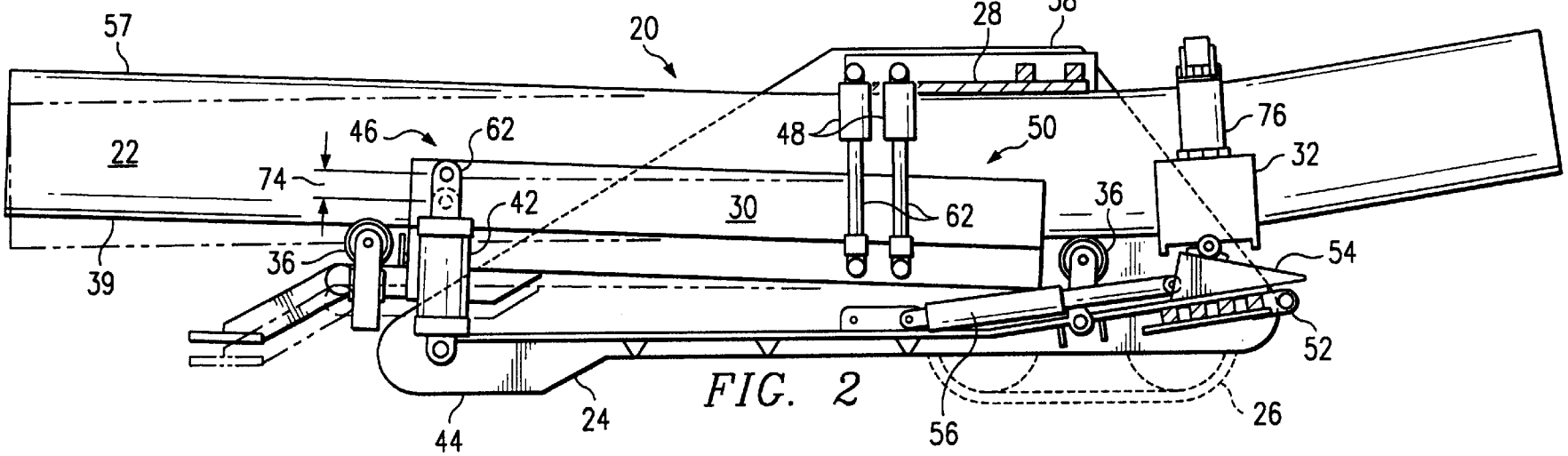
FIG. 2 is a side view of the pipe bending apparatus of FIG. 1, showing the operation of placing a bend in the pipe.

With reference now to the drawings, there is illustrated in FIGS. 1 and 2 a pipe bending apparatus 20 according to a preferred embodiment of the current invention. The pipe bending apparatus 20 is used to bend a pipe section 22 into a desired curvature by the use of hydraulic force. It can be observed that the pipe bending apparatus 20 includes a frame 24 for supporting the remaining components. A caterpillar assembly 26 is mounted to the frame 24 to provide mobility for the apparatus.

The pipe bending apparatus 20 using a bending mechanism that includes a bending die 28, a stiffback 30, and a pin-up shoe 32. FIG. 1 shows the pipe bending apparatus 20 in the starting position for a bend. A length of pipe section 22 has been inserted into the pipe bending apparatus 20 from the rear end 34, over the pin-up shoe 32, and onto the stiffback 30. Rollers 36 may be provided to facilitate movement of the pipe section through the apparatus. An axial positioning mechanism (not shown) is used to move the pipe section 22 axially along the stiffback 30 until the appropriate portion of the pipe section is positioned beneath the bending die 28. Such axial positioning mechanisms are known in the art and will not be further described here. The bending die 28 is rigidly attached to the upper portion 38 of the frame 24. The bending die 28 has a curved lower surface 40 designed to impart the desired bend radius onto the pipe section 22 during bending. The stiffback 30 has a trough-like cross section for supporting the lower surface 39 of the pipe section 22 during bending. The stiffback 30 is connected to the frame 24 by at least one hydraulic bending cylinder which, when operated, moves the stiffback relative to the frame (hence, also relative to the bending die 28). In the preferred embodiment shown in FIGS. 1 and 2, two outboard hydraulic bending cylinders 42 (one on each side) are connected between the front portion 44 of the frame 24 and the front portion 46 of the stiffback 30, and four inboard hydraulic bearing cylinders 48 (two on each side) are connected between the upper portion 38 of the frame and the rear portion 50 of the stiffback. The pin-up shoe 32 is connected to the rear portion 52 of the frame 24 for supporting the rear portion of the pipe section 22 during bending. The vertical position of the pin-up shoe 32 can be adjusted by axially sliding a pin-up wedge 54 using a hydraulic pin-up cylinder 56. In the starting position illustrated in FIG. 1, the pin-up cylinder 56 is retracted such that the pin-up shoe 32 is at its lowest vertical position and spaced apart from the lower surface 39 of the pipe section 22 in order to facilitate movement of the pipe through the apparatus. It will also be noted that in the starting position as illustrated in FIG. 1, the stiffback 30 is vertically positioned such that the upper surface 57 of the pipe section 22 supported therein is spaced apart from the lower surface 40 of the bending die 28 by a clearance distance (denoted by reference number 58) to further facilitate movement of the pipe section through the apparatus.

This clearance distance 58 is typically within the range of about 2½ inches to 3½ inches, and preferable is about 3 inches.

Figure 3A:
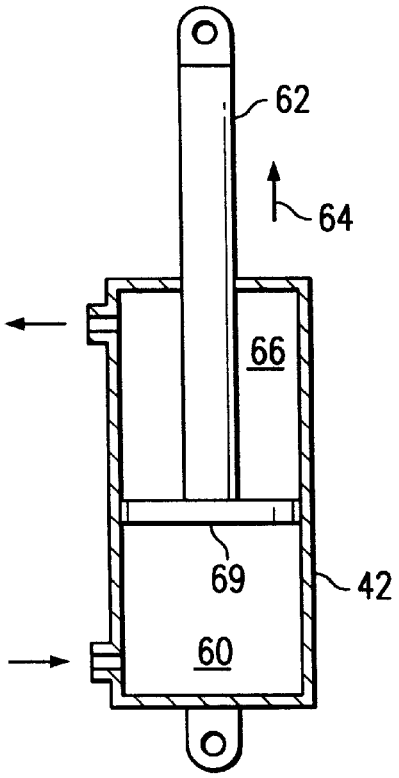
FIGS. 3A and 3B are cross sectional views of the outboard and inboard bending cylinders, respectively, for the apparatus of FIG. 1 showing the direction of fluid flow and rod movement during the leveling operation.
Figure 3B:
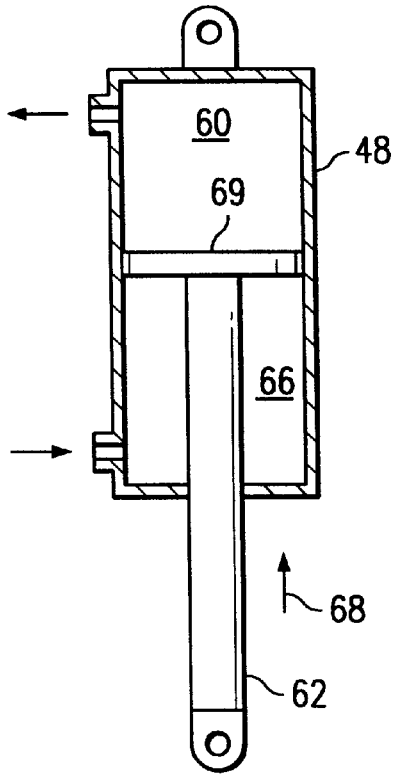

Once the pipe section 22 has been axially positioned for the bend, the stiffback 30 is raised vertically to bring the upper surface 57 of the pipe into contact with the bending die 28. This is often referred to as the leveling operation. In the preferred embodiment, leveling is accomplished by supplying pressurized hydraulic fluid to the outboard and inboard bending cylinders 42, 48. Referring now also to FIGS. 3A and 3B, in the preferred embodiment raising the front end 46 of the stiffback 30 is performed by supplying high pressure hydraulic fluid to the blind end 60 of the outboard bending cylinders 42 thereby causing cylinder rod 62 to extend as indicated by arrow 64. Raising the rear end 50 of the stiffback is performed by applying high pressure hydraulic fluid to the rod end 66 of the inboard bending cylinders 48, thereby causing the cylinder rod 62 to retract as denoted by arrow 68. Of course, as the bending cylinders move (i.e., extend or retract) during the leveling operaiton, movement of the cylinder pistons 69 will force hydraulic fluid out from the opposite end.

During the leveling operation, both the pipe section 22 and the stiffback 30 are raised vertically for a distance (denoted by reference numbers 70 and 72, respectively) approximately equal to the original die clearance distance 58, resulting in a final configuration as shown by the dotted lines in FIG. 1.

After leveling is completed, the pipe section 22 and stiffback 30 will have the configuration shown by the dotted lines in FIG. 2. The pin-up cylinder 56 is now extended to move the pin-up wedge 54 against the pin-up shoe 32 until the shoe contacts the lower surface 39 of the pipe section 22. Next, high pressure hydraulic fluid is again supplied to the bending cylinders 42, 48 as previously described, to perform the actual bending of the pipe section. However, because the upper surface 57 of the pipe section is already positioned against the bending die 28, the inboard cylinders 48 cannot retract further when pressurized but merely clamp the pipe tightly to the die (the combined force of the inboard cylinders 48 is limited to prevent them from exceeding the strength of the pipe). The outboard bending cylinders 42, however, are not similarly restrained and therefore extend rods 62 by a bending distance (denoted by reference number 74) causing the front end 46 of the stiffback 30 to force the pipe section 22 against the bending die 28 and pin-up shoe 32 creating the bend. A hydraulic pin-up clamp 76 positioned adjacent to the pin-up shoe 32 may also be pressurized during bending for securing the rear end of the pipe section to the shoe. The bending distance 74 for a typical bend is in the range of about 4 inches to about 6 inches, and more preferably about 5 inches. After the bend has been formed, the flow of hydraulic fluid to the bending cylinders 42, 48 and pin-up clamp 76 is reversed from that previously described, causing the outboard bending cylinders 42 to retract their cylinder rods 62 back to the starting position and causing the inboard bending cylinders 48 to extend their cylinder rods 62 back to the starting position and causing the pin-up clamp 76 to release the rear portion of the pipe section 22 so that it can be repositioned with the next bend (if additional bends are required) or for removal from the apparatus (if bending is completed).

It is significant to note that the force required to raise the pipe section 22 during the leveling operation is typically much less than the force required to bend the pipe during the bending operation. For example, a forty foot section of 36 inch diameter of ½ inch wall thickness pipe made of 90 ksi steel weighs approximately 7,600 pounds and the weight of the mandrel positioned in the pipe at the time of bending is approximately 3,200 pounds. Thus, the bending cylinders 42, 48 must produce a total force of approximately 18,400 pounds during the leveling operation. To actually bend the same pipe, however, requires the stiffback to exert approximately 361,000 pounds of force which must be supplied by the outboard cylinders 42 only. The current invention utilizes this differential force requirement to provide an improved bending apparatus and a new method for bending a pipe which allows for the more efficient operation of such apparatus.

Figure 4:
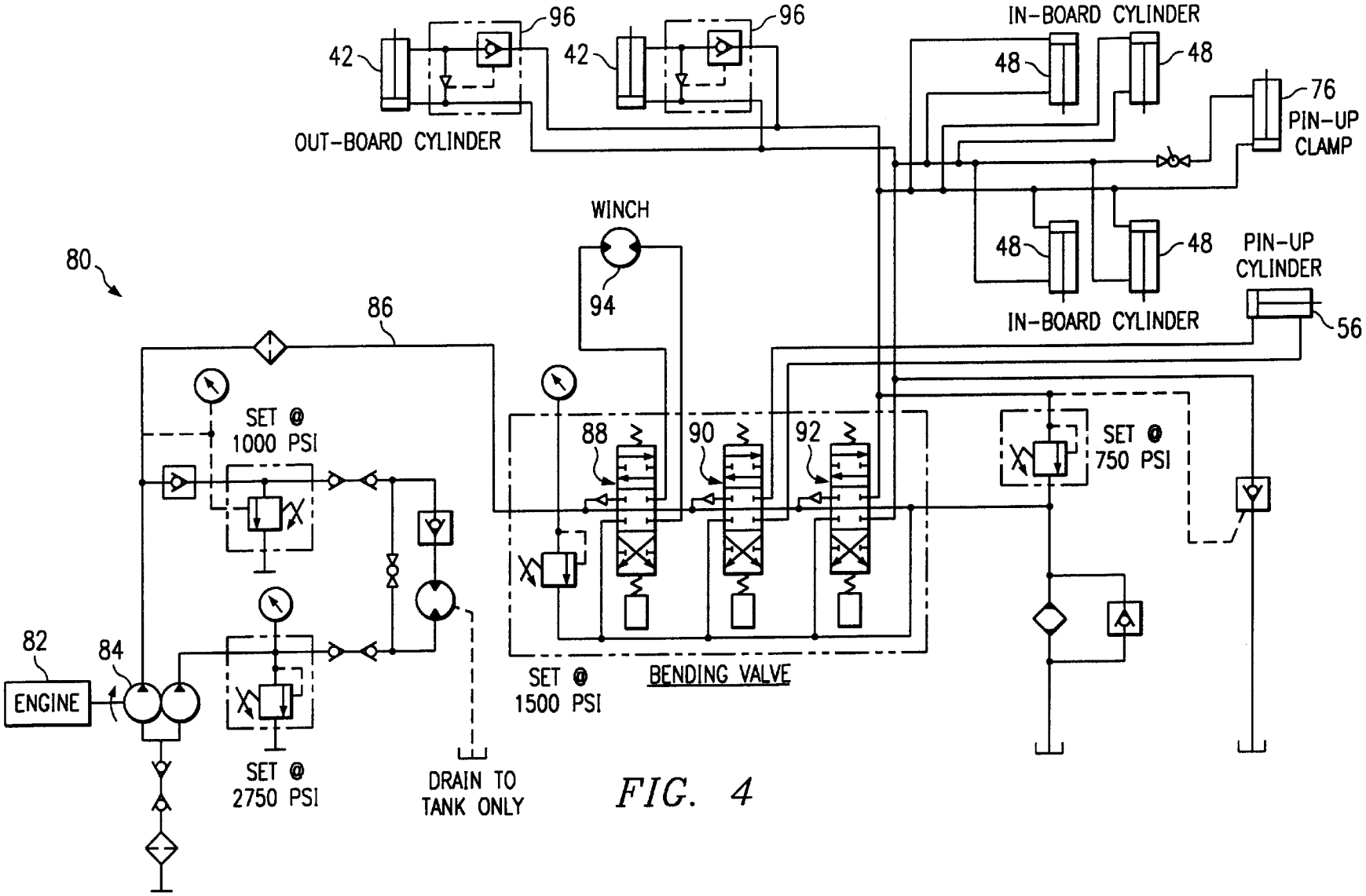
FIG. 4 is a schematic diagram of a hydraulic system suitable for use in the bending machine of FIG. 1.
Figure 6D:
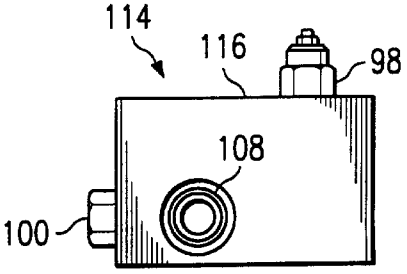
FIGS. 6A–6D are right side, front, left side and bottom views, respectively, of a regenerative manifold assembly suitable for use in the system of FIG. 4.
Figure 6C:
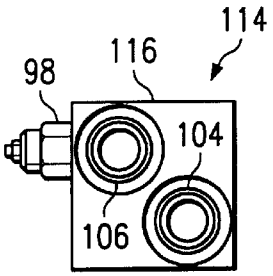
Figure 6B:
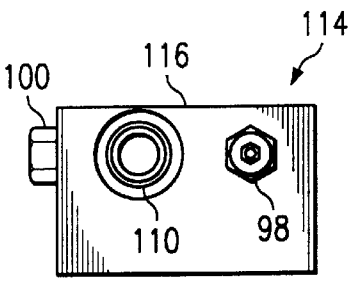
Figure 6A:
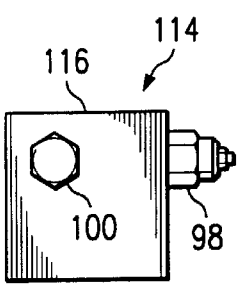

To power and control the various hydraulic mechanisms comprising the pipe bending apparatus 20, a hydraulic fluid supply system is provided. FIG. 4 shows a schematic diagram of a hydraulic system 80 suitable for use on the preferred apparatus of FIG. 1. The hydraulic system 80 includes an engine 82 powering a hydraulic pump 84, various hydraulic supply lines 86 connected between the components of the bender and the components of the hydraulic system and hydraulic control valves 88, 90 and 92 for controlling, respectively, the axial positioning mechanism 94 (in this case, a hydraulic winch), the bending mechanism (including outboard bending cylinders 42, inboard bending cylinders 48 and pin-up clamp 76) and the pin-up cylinder 56 of the pin-up mechanism. With the exception of two pressure-sensitive regenerative valve assemblies 96, the purpose of which will be discussed below, the hydraulic system 80 is of a type generally known, the design and components of which can be readily understood from a review of the schematic shown in FIG. 4, thus it will not be further discussed here.

Figure 5:
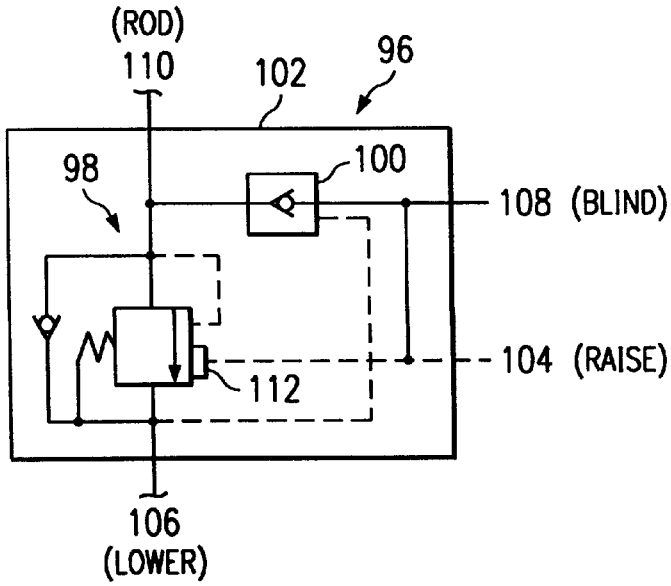
FIG. 5 is an enlarged schematic diagram of the regenerative manifold assembly of FIG. 4.

Referring now also to FIG. 5, an enlarged schematic diagram is provided showing a pressure sensitive regenerative valve assembly 96 of a type suitable for use in the system of FIG. 4 to operate an apparatus according to the current invention. The regenerative valve 96 comprises a counterbalance valve 98 and a check valve 100 installed in a manifold 102. The "raise bender" supply line is connected to port 104, the "lower bender" supply line is connected to port 106, the port 108 is connected to the blind end 60 of the outboard bending cylinder 42 and the port 110 is connected to the rod end 66 of the outboard bending valve. The counterbalance valve 98 includes a pressure sensitive pilot valve 112 which senses the pressure between ports 104 and 108 (i.e., the pressure at the blind end of the outboard bending cylinder). When the pressure in the blind end of the outboard bending cylinder 62 is less than a predetermined pressure, the pilot valve 112 remains closed, blocking the flow of fluid from the rod end of the outboard bending cylinder and forcing this fluid to flow through check valve 100 and through port 108 where it is added to the pump flow being supplied to the blind end of the outboard bending cylinder. This additional flow causes the bending cylinder to advance much more rapidly than it would on pump flow alone. A consequence of this regenerative flow is, however, a reduction in the effective force produced by the outboard bending cylinder. Whereas the normal output force would be equal to the blind end area times the fluid supply pressure, when regenerative flow is being used, the effective force is reduced to the rod area times the fluid pressure. For example, for an outboard cylinder having a bore diameter of 11 inches and a rod diameter of 9 inches, the effective force at 1,000 psi fluid pressure would equal 95,030 pounds, whereas with regeneration, the effective output force would be reduced to 63,600 pounds, a 33 percent reduction. Even though the literature teaches that regeneration is useful only with a 2:1 ratio between cylinder and rod diameters, the present invention is useful with an 11:9 ratio. For the same cylinder, however, the extension speed without regeneration for an assumed flow of 25 gallons per minute, would equal 1.01 inches per second, whereas the extension speed with regeneration would be 1.51 inches per second, an increase of approximately 50 percent. When, however, the pressure at the blind end of the outboard bending cylinder meets or exceeds the predetermined pressure, the pilot valve 112 will move to the open position such that fluid exiting the rod end of the outboard bending cylinder will flow out port 106 and return to the hydraulic system tank in a conventional manner, thus terminating the regenerative effect. Of course, termination of fluid regeneration causes the extension speed of the cylinder to return to its normal speed but also causes the extension force to return to its conventional force. Thus, by use of a pressure sensitive regenerative valve assembly, a "two-speed" hydraulic system is provided which allows increased cylinder extension speed when relatively low forces are required, for example during the leveling operation, but then allows the system to automatically switch into a non-regenerative mode with a somewhat slower extension speed but with greatly increased extension force when relatively high forces are required, for example during the bending operation.

Referring now to FIGS. 6A–6D, shown is a regenerative valve assembly 114 corresponding to the schematic circuit of FIG. 5. The regenerative valve assembly 114 comprises the counterbalance valve 98 and check valve 100 previously described installed in a manifold block 116 providing the necessary passages and ports as shown. The regenerative valve assembly 114 may be used in the construction of new pipe bending apparatus according to the current invention, and it can also be retrofit on existing non-regenerative pipe bending apparatus so as to provide a very inexpensive way of achieving the benefits of regenerative operation. Those of ordinary skill will readily appreciate how the regenerative valve assembly 114 can be integrated into a prior art (non-regenerative) type of pipe bending apparatus, therefore the specifics of such retrofit will not be discussed further here.

Figure 7:
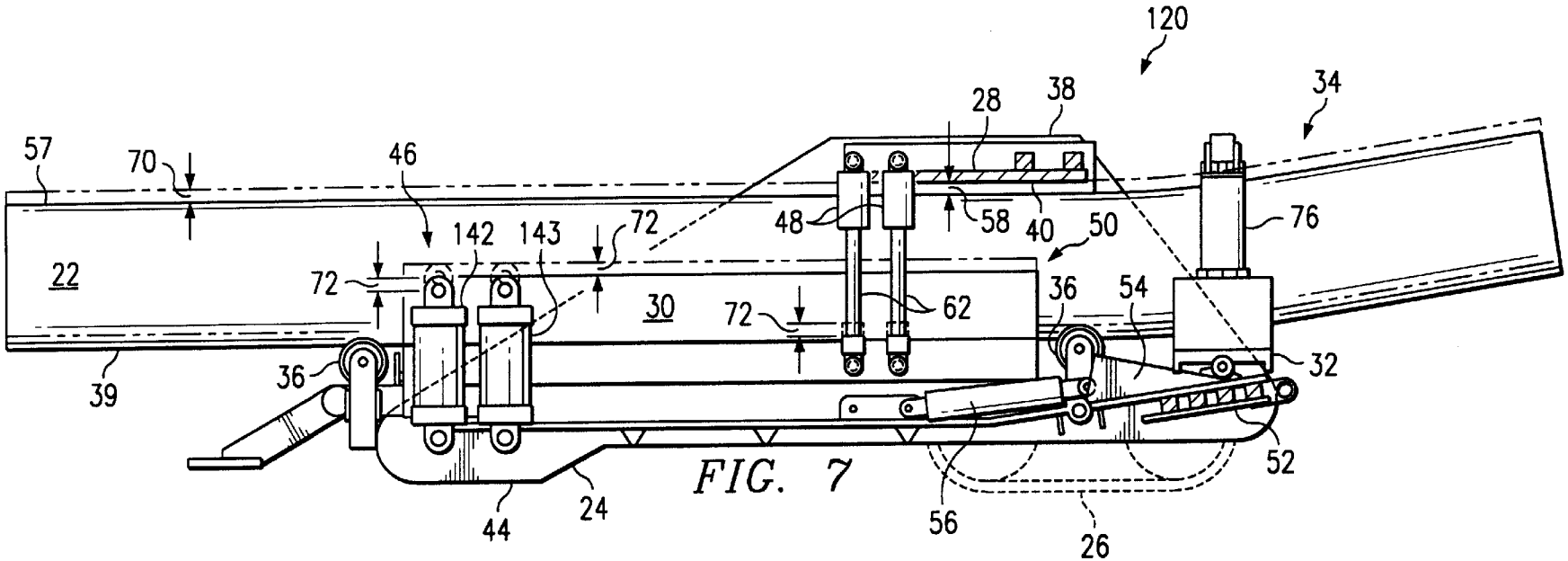
FIG. 7 is a pipe bending apparatus according to another embodiment of the current invention.

Referring now to FIGS. 7, a pipe bending apparatus 120 according to another embodiment of the current invention is shown. The pipe bending apparatus 120 is identical to the pipe bending apparatus of FIGS. 1 and 2 except for the fact that it incorporates four outboard bending cylinders 42 (two on each side) and utilizes a different hydraulic control system. Therefore, the description of the second embodiment will be confined primarily to the differences between this embodiment and that disclosed in FIGS. 1 and 2. As previously indicated, the pipe bending apparatus 120 has four outboard bending cylinders, and two front outboard cylinders 142 (one on each side) and two rear outboard cylinders 143 (one on each side). The outboard cylinders 142, 143 may be the same size as one another, or the cylinders 142 may be a different size from the cylinders 143, depending upon the operational characteristics desired.

Figure 8:
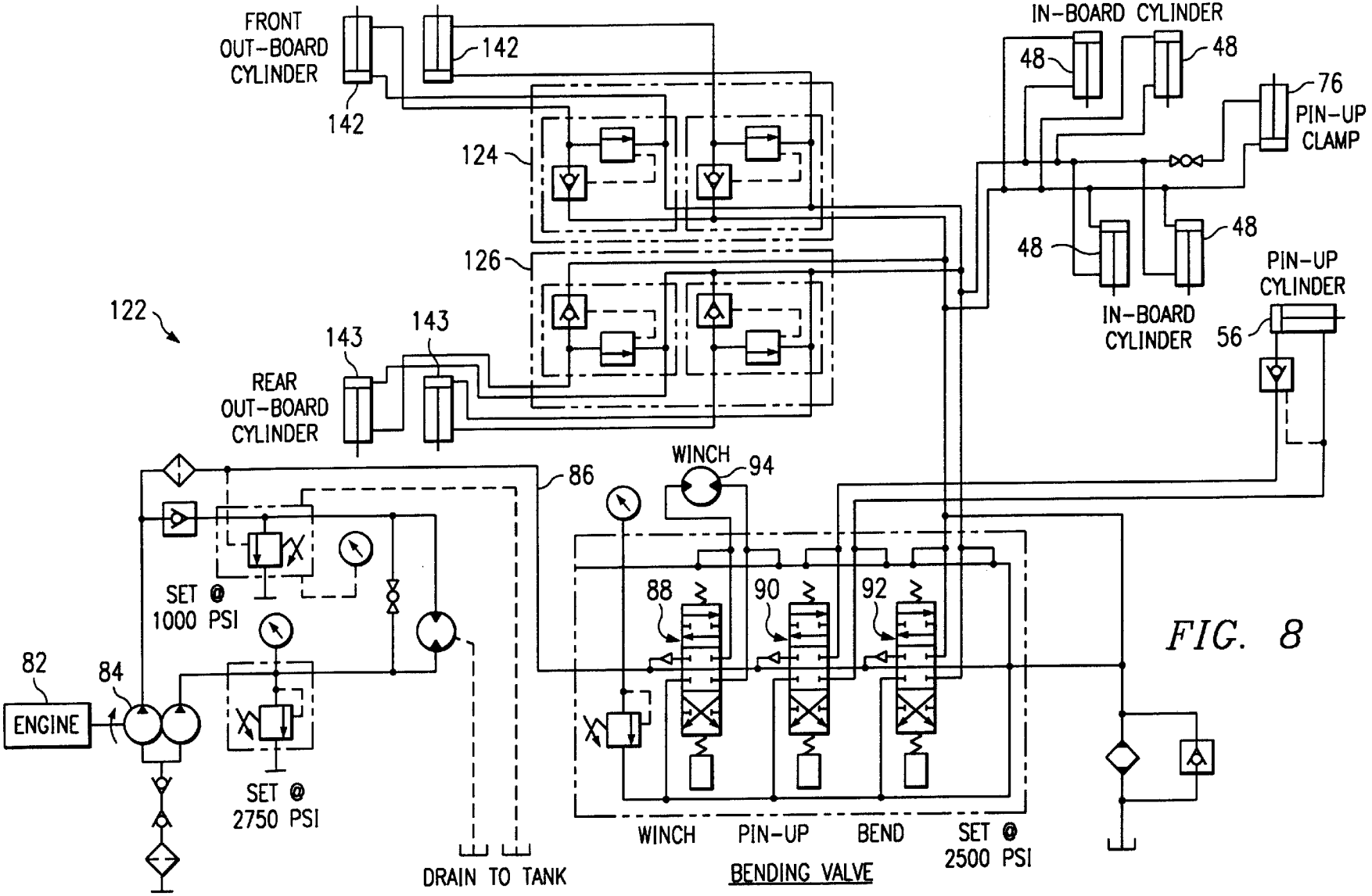
FIG. 8 is a schematic diagram of a hydraulic system suitable for use in the bending machine of FIG. 7.
Figure 9:
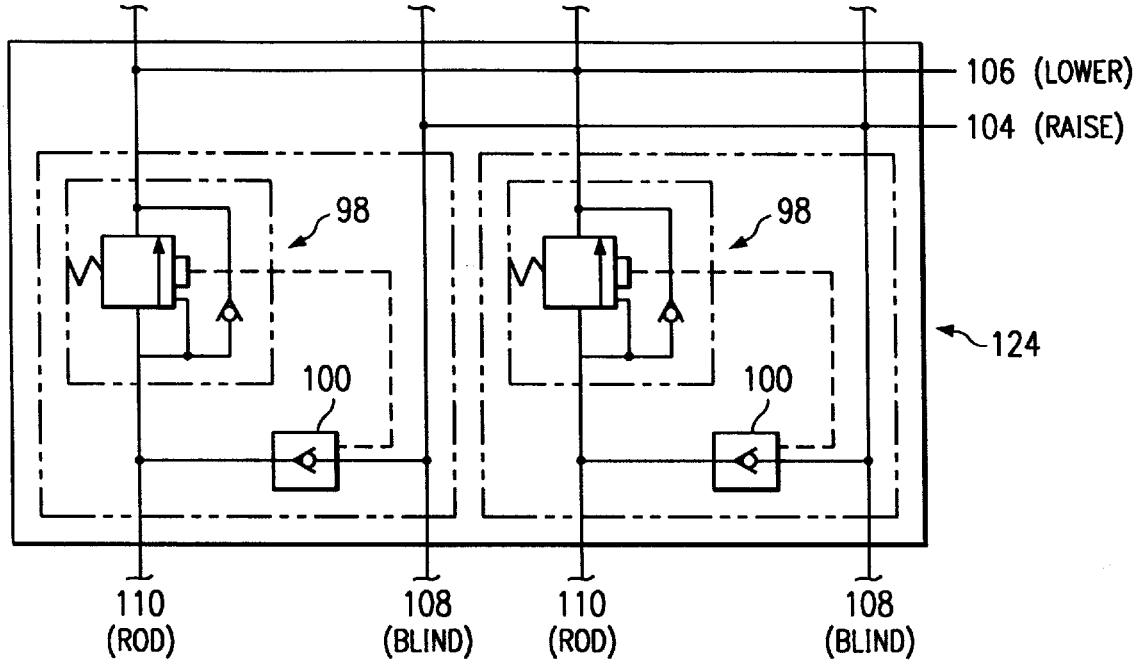
FIG. 9 is an enlarged schematic diagram of a dual regenerative manifold assembly suitable for use in the hydraulic system of FIG. 8.

Referring now also to FIG. 8, a modified hydraulic fluid supply system 122 is provided for operation of the pipe bending apparatus 120. The hydraulic system 122 is similar in most respects to the system 80 previously disclosed. Thus, only the significant modifications will be discussed in detail. A significant change is that hydraulic system 122 now includes supply lines for four outboard cylinders, the two front outboard cylinders 142 and the two rear outboard cylinders 143. Further, regenerative control for each pair of outboard cylinders 142, 143 is provided by a dual regenerative valve assembly 124, 126, respectively. Referring now also to FIG. 9, an enlarged schematic diagram is provided showing the dual regenerative manifold assembly 124 of a type suitable for use in a system of FIG. 8. The dual valve assembly 124 is identical in all ways with dual valve assembly 126 except possibly for flow capacity and pressure settings, therefore it will not be separately discussed. The dual regenerative valve comprises two pressure sensitive regenerative valve assemblies installed in a single manifold in order to facilitate installation and operation. Each of the regenerative valves comprises a counterbalance valve 98 and a check valve 100 operating as previously described for valve 96. The supply port connections 104, 106 and cylinder connections 108, 110 are also identical to those previously disclosed for valve 96 except that two sets of cylinder connection ports are provided so that a pair of cylinders can be controlled with a single set of supply lines.

Figure 10A:
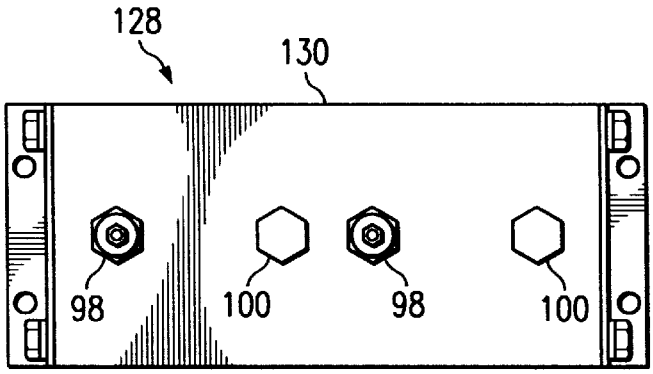
FIGS. 10A–10C are top, left side and front views, respectively, of a dual cylinder regenerative manifold assembly suitable for use in the system of FIG. 8.
Figure 10B:
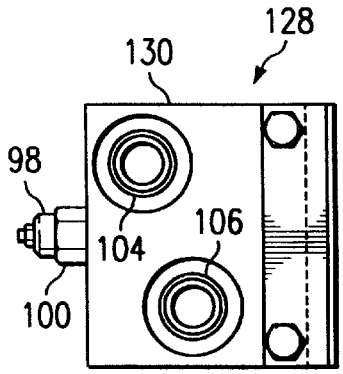
Figure 10C:
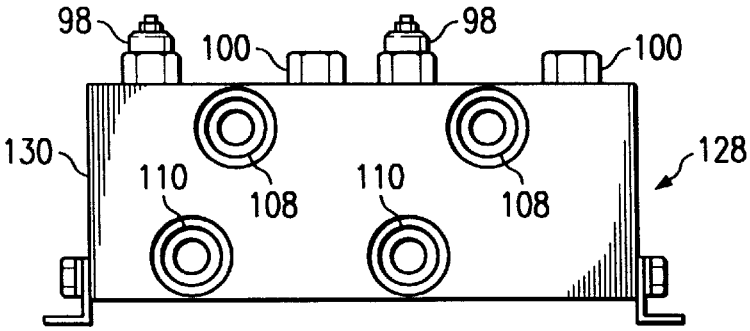

Referring now to FIGS. 10A–10C, shown is a regenerative valve assembly 128 corresponding to the schematic circuit of FIG. 9. The regenerative valve assembly 128 comprises two counterbalance valves 98 and two check valves 100 as previously described installed in a dual manifold block 130 which provides the necessary passages and ports as shown. The dual regenerative valve assembly 128 may be used in the construction of new pipe bending apparatus according to the current invention, and it can also be retrofit on existing non-regenerative pipe bending apparatus having dual outboard bending cylinders so as to provide an inexpensive way of achieving benefits of regenerative operation.

Figure 11:
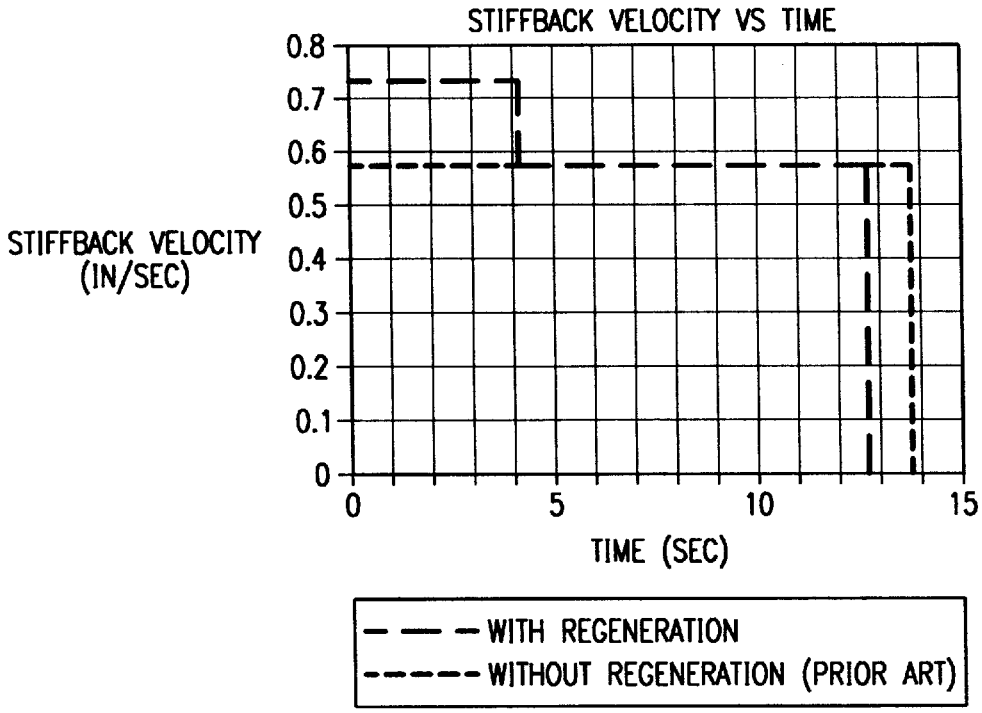
FIG. 11 is a graph showing stiffback velocity versus time for the bending apparatus of the current invention and for the prior art when bending a first type of pipe.
Figure 12:
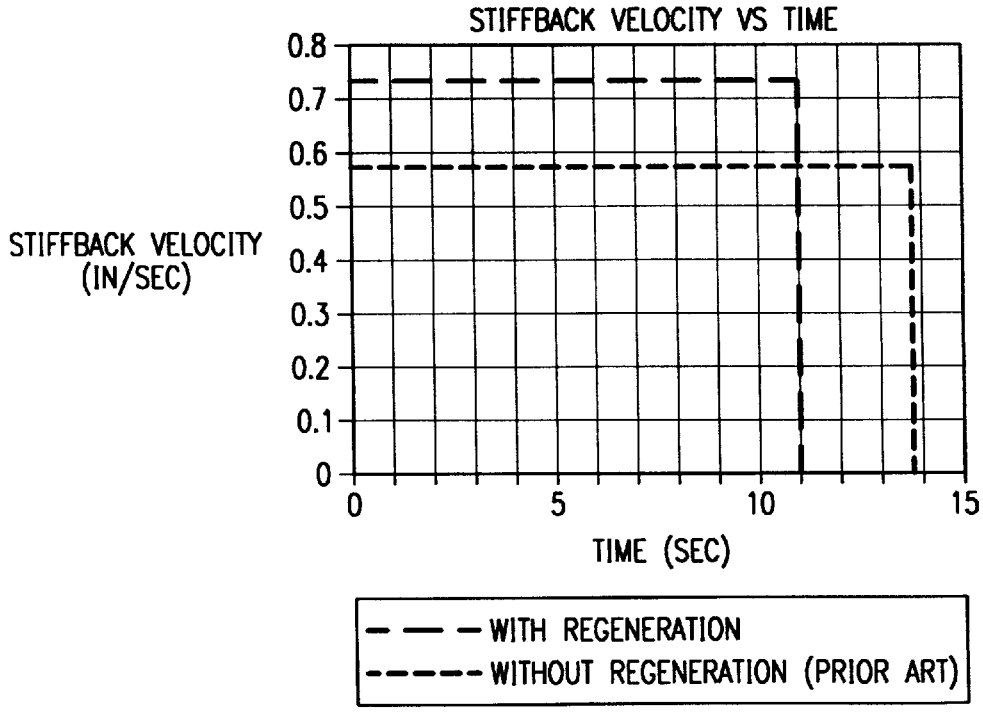
FIG. 12 is a graph showing stiffback velocity versus time for the apparatus of the current invention and for the prior art when bending a second type of pipe.

Operation of the pipe bending apparatus 120 with four outboard bending cylinders 142, 143 using the hydraulic system 122 or other hydraulic systems allowing the predetermined pressure at which regeneration starts to be set for each individual cylinder provides the system operator with several options for operation. First, if the pilot valves in the regenerative valve assemblies are set to operate at the same predetermined pressure, then all of the outboard bending cylinders 142, 143 controlled by these valves will begin and end regenerative operation in unison. This will essentially provide for two speed and two force level operations as previously described. Second, if the pilot valves controlling the front outboard bending valves are set to operate at different predetermined pressure from the pilot valves controlling the rear outboard bending cylinders, then the system will operate in a three speed, three force mode which may result in even greater effeciencies in operation. Referring now to FIGS. 11 and 12, examples showing the benefits of the current invention are provided. In both examples, it is assumed that the pipe bending apparatus has two outboard bending cylinders, each having a bore diameter of 11 inches and a rod diameter of 9 inches and four inboard bending cylinders, each having a bore diameter of 7 inches and a rod diameter of 2½ inches. The outboard bending cylinders are set up to bend in push mode (fluid to blind end) while the inboard bending cylinders are set up to bend in pull mode (fluid supplied to rod end). Further, these examples assume the hydraulic pump has a total output of 50 gpm. Finally, it is assumed in these examples that the leveling operation involves a lift distance (i.e., clearance distance) of approximately 3 inches for both the inboard and outboard bending cylinders, and that the bending operation requires an additional 5 inches of extension for the outboard bending cylinders only. In the first example, a bend is produced in a section of 36 inch by ½ inch wall pipe made from 90 ksi steel. Since the leveling operation requires only 18,400 pounds of force, this can be accomplished with the outboard bending cylinders in regenerative mode. In this mode, the lifting operation proceeds at 0.72 inches per second, thus requiring 4.13 seconds for the 3 inch lift. Once the pipe engages the die, however, approximately 361,000 pounds of force is required to actually bend the pipe, requiring a rise in the fluid pressure to approximately 1900 psi, which causes the regenerative valve assemblies to terminate the regenerative mode and enter conventional mode, in which the outboard cylinders travel at only 0.59 inches per second. Thus, the bending operation requires approximately 8.47 additional seconds for a total leveling and bending time of 12.75 seconds. Producing a bend under identical conditions on a prior art pipe bending apparatus without regeneration would involve allowing the outboard cylinders to travel through both the leveling and bending operations at a constant speed of 0.59 inches per second, thus requiring approximately 13.73 seconds for the combined leveling and bending operation. Thus the time saved per bend is approximately 0.98 seconds or approximately one second. Although one second may not seem like significant savings, if twenty bends are performed on each pipe section, then the time savings per pipe section would amount to approximately 19.6 seconds. Further assuming that an operator bends 100 forty-foot joints per day, the time savings of 19.6 seconds per joint would amount to almost 2,000 seconds, or over one-half hour. This represents a significant increase in efficiency of the bending operation which can be of real benefit to the pipeline contractor.

The second example involves the bending of a smaller diameter pipe having a lower yield strength. To bend a section of 30 inch by ½ inch wall pipe made of 72 ksi steel, only about 196,000 pounds of force are required from the outboard bending cylinders. Therefore, it is possible to run the entire bending cycle in regenerative mode since the maximum fluid pressure required is only 1,540 psi. As seen in FIG. 12, leveling and bending in regenerative mode at a travel speed of 0.73 inches per second takes a total time of approximately 11 seconds, whereas leveling and bending with a non-regenerative pipe bending apparatus according to the prior art will again require the entire bend to be performed at a speed of 0.58 inches per second for a total time of 13.73 seconds. Thus in this example, the savings per bend are approximately 2.73 seconds. Again assuming 20 bends per pipe section and 100 pipe sections per day, the time savings using the current invention would amount to approximately 91 minutes per day.

While two embodiments of the present inventions have been described in detail herein and shown in the accompanying drawings, it will be evident that further modifications or substitutions of parts and elements are possible without departing from the scope of the current invention.

I claim:

1. A pipe bending apparatus comprising:

a bending mechanism including a bending die, a stiffback, and at least one outboard bending cylinder, the bending die being rigidly mounted to a frame of the apparatus, the stiffback being movable with respect to the frame, and the outboard bending cylinder having a rod end and a blind end and being operably connected between the stiffback and the frame for moving the stiffback toward the bending die when pressurized hydraulic fluid is supplied to the blind end; and a hydraulic fluid supply system including a hydraulic pump and at least one pressure-sensitive regenerative valve assembly, the supply system being operably connected to the outboard bending cylinder such that when pressurized hydraulic fluid is being supplied to the blind end of the outboard bending cylinder and a fluid pressure in the blind end is less than a predetermined pressure, the hydraulic fluid exiting the rod end of the outboard bending cylinder is routed into the blind end without first passing through the hydraulic pump, and when pressurized hydraulic fluid is being supplied to the blind end of the outboard bending cylinder and the fluid pressure in the blind end is at least the predetermined pressure, the hydraulic fluid exiting the rod end of the outboard bending cylinder is routed back to the hydraulic pump.

2. A pipe bending apparatus in accordance with claim 1, the apparatus further comprising at least one inboard bending cylinder, the inboard bending cylinder having a rod end and a blind end and being operably connected between the stiffback and the frame for moving the stiffback toward the bending die when pressurized hydraulic fluid is supplied to the rod end.

3. A pipe bending apparatus in accordance with claim 2, the apparatus further comprising a hydraulic pin-up mechanism operably connected to the hydraulic fluid supply system.

4. A pipe bending apparatus in accordance with claim 3, the apparatus further comprising an axial pipe positioning mechanism.

5. A method of bending a pipe section using a pipe bending apparatus having an axial pipe positioning mechanism, a bending mechanism including a bending die, a movable stiffback, and at least one hydraulic bending cylinder which has a rod end and a blind end and is operably connected to the stiffback for moving the stiffback with respect to the die, and a pin-up mechanism, the method comprising the following steps performed in the given order:

operating the axial positioning mechanism to move the pipe section axially along the stiffback until a first portion of the pipe section is supported on the stiffback and the pipe section is axially positioned for bending;

supplying hydraulic fluid to the blind end of the hydraulic bending cylinder to raise the stiffback vertically until the upper side of the pipe section comes into contact with the bending die, at least a portion of such hydraulic fluid being supplied to the blind end being fluid which exited the rod end of the bending cylinder and was routed into the blind end of the bending cylinder without first passing through a hydraulic pump;

operating the pin-up mechanism until it moves into contact with the lower side of the pipe section and supports a second portion of said pipe section;

supplying additional hydraulic fluid to the blind end of the hydraulic bending cylinder to further raise the stiffback and bend the pipe section supported thereon against the bending die.

* * * * *